United States Patent [19]

Lehmacher

[11] 4,333,298

[45] Jun. 8, 1982

[54] METHOD OF AND APPARATUS FOR BOXING SHOPPING BAGS

[76] Inventor: Hans Lehmacher, Im Hummerich, 5216 Niederkassel-Mondorf, Fed. Rep. of Germany

[21] Appl. No.: 127,064

[22] Filed: Mar. 4, 1980

[30] Foreign Application Priority Data

Mar. 7, 1979 [DE] Fed. Rep. of Germany ..... 2908943

[51] Int. Cl.[3] ..... B65B 35/50; B65B 39/00; B65B 5/08

[52] U.S. Cl. ..... 53/447; 53/473; 53/540; 53/247; 53/258; 414/43; 414/96

[58] Field of Search ..... 53/541, 540, 258, 247, 53/249, 260, 143, 447, 475, 544, 116, 473, 120; 414/43, 96, 92, 907

[56] References Cited

U.S. PATENT DOCUMENTS

| | | | |
|---|---|---|---|
| 1,532,153 | 4/1925 | Palmer | 53/143 |
| 2,767,534 | 10/1956 | Nydegger et al. | 53/540 X |
| 3,107,793 | 10/1963 | Frank | 53/541 X |
| 3,194,127 | 7/1965 | Larsson | 414/43 X |
| 3,766,701 | 10/1973 | Besserdich et al. | 53/540 X |
| 3,837,140 | 9/1974 | Golantsev et al. | 414/43 X |
| 3,977,152 | 8/1976 | Rochla et al. | 53/540 X |
| 3,986,319 | 10/1976 | Puskarz et al. | 53/447 |

*Primary Examiner*—Horace M. Culver
*Attorney, Agent, or Firm*—Karl F. Ross

[57] ABSTRACT

A bag-making apparatus delivers to a stacking station a succession of like flat and flexible folded shopping bags. A packaging apparatus stacks these bags at the stacking station up into a stack with the objects generally planar in the stack. The stack is then transferred to a loading cassette provided in a packaging station adjacent the stacking station and having a floor formed with an elongated throughgoing slot. An upwardly open carton is then positioned under and around the cassette and the stack is pushed out of the slot in the bottom of the floor of the cassette, temporarily deforming each of the bags from planar to U-shape as they pass through the slot. In this manner the entire stack is pushed through the slot into the carton.

12 Claims, 8 Drawing Figures

METHOD OF AND APPARATUS FOR BOXING SHOPPING BAGS

FIELD OF THE INVENTION

The present invention relates to a method of and an apparatus for boxing shopping bags. More particularly this invention concerns a system for receiving shopping bags as they are produced by a bag-making machine and packaging them in stacks in shipping cartons.

BACKGROUND OF THE INVENTION

In my copending and now abandoned application Ser. No. 046,040 filed June 6, 1979 I disclose a bag-making machine wherein a synthetic-resin tube whose leading end has been closed at a first top seam is conveyed longitudinally to a position inside a fixed punching station. A piece of this tube is cut off at the first top seam to leave top-seam portions defining handles and forming a filling opening, and at the same time the tube is formed downstream with a pair of parallel and spaced-apart seams. The downstream seam of this pair constitutes the bottom seam of the bag and the other seam of the pair constitutes the top seam of the next bag to be produced. The tube is cut across between these seams and is tucked between its upstream and downstream ends into a secondary conveyor which transports it away transverse to the normal transport direction to deposit it, folded in half, on top of a stack of such bags.

Such an arrangement is highly efficient at producing extremely useful shopping bags of the so-called undershirt type having a pair of integral handle loops. Although my earlier application envisages depositing the bags directly onto a stack, it has been found that this method is not always satisfactory. Mainly the bags are cumbersome to handle, even if folded in half, so that they frequently form a relatively messy stack in the box. What is more the bags when always stacked in the same orientation form a stack whose top normally tips considerably in one direction due to the different thicknesses of the various parts of the bags. Furthermore this arrangement does not lend itself to an automatic filling of shipping cartons with the bags without operator supervision.

OBJECTS OF THE INVENTION

It is therefore an object of the present invention to provide an improved method of and apparatus for automatically packaging bags as they arrive from a bag-making machine or the like in a fully automatic operation.

Another object is to provide an improved packaging system usable not only with bags according to my earlier copending application but also with other flat and flexible workpieces which are shipped in stacks in cartons.

SUMMARY OF THE INVENTION

These objects are attained according to the instant invention in a method and apparatus wherein the succession of like flat and flexible objects such as folded shopping bags is formed into a stack of such objects with the objects generally planar and parallel to each other in the stack. Transfer means including a gripper are displaceable from the stacking station to a packaging station provided with a loading cassette having a floor formed with an elongate throughgoing slot. This gripper displaces the entire stack into the cassette so that it lies on the floor above the elongate throughgoing slot thereof. An upwardly open carton is then positioned under and around the cassette and the cassette and carton are then relatively displaced while the stack is pushed through the slot in the floor of the cassette. This action temporarily deforms the objects into U-section as they pass through the slot, but as soon as they have passed through it they flatten out again to lie neatly in the bottom of the carton.

Thus the system according to the instant invention allows a flat stack to be formed and then to be transferred in a very simple manner to a carton. The arrangement can operate continuously as during the time it takes a stack to form it is possible for a new carton to be moved into place, although normally several stacks are positioned one atop another inside a single carton.

According to another feature of this invention the cassette, which must normally be in a given orientation relative to a vertical axis during loading, is rotated through a different angle, normally in increments of 90°, with each successive stack. Thus it is possible for the stacks to be rested one atop the other with the bags of each stack pointing in a different direction so that an evenly stacked pile is made which will have an upper surface parallel to its lower surface.

According to further features of this invention the stack is formed not in the conventional manner by simply dropping each newly arrived object on top of a pile of such objects, but instead is formed from the bottom up. This is achieved by providing a stack holder having a lower flange extending horizontally and downstream in the transport direction beneath a hold-down device. A lifter is provided beneath a continuous transport element which delivers the objects one at a time to the stacking station. This lifter can pass between the two belts constituting the conveyor element when an object is aligned above it with the stack holder so as to push the trailing edge of this object up from a position below the holding flange to a position above it where it is then pressed down against it again and held in place by the hold-down device. Thus the stack is held in this holder by gripping of its upstream edge between the hold-down device on the top and the flange on the bottom. This allows the entire stack to be pulled out of the stack holder in a very simple manner by the gripper which grips it from above and below at the downstream edges of the objects. The gripper need merely pull it out from between the hold-down device and the flange after, if desired, relaxing of the hold-down device. It is also within the scope of this invention to provide a pair of vertically spaced conveyor belts which grip the stack and displace it from the stacking to the packaging station.

At the packaging station according to this invention the cassette is vertically displaceable from a lower position in which it is horizontally aligned with the stack holder so that the stack can be easily displaced horizontally right into the cassette into an upper position well above the gripper so that this element can move back upstream to a position at the stack holder for the next cycle, and back into the lower position into a carton which meanwhile has been transported, normally transversely, into a position directly below the cassette.

Thus the system according to the instant invention operates automatically to stack up the objects, then to load the stacks into cartons. One stack can be loaded into each carton or a plurality of such stacks. In any situation the apparatus operates entirely automatically so that it is possible to produce boxes of these objects, which according to this invention are normally folded shopping bags, which are usable directly from the box. Thus the full box can merely be placed under the counter in a store or the like and be provided with a slot so that the user need merely reach into the box and engage his or her hand into the cutout of the uppermost bag to grip it adjacent the edge of this cutout and lift it from the carton.

SPECIFIC DESCRIPTION

Figure 6:
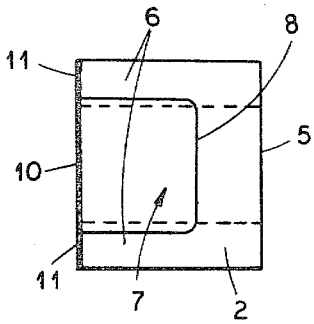
FIG. 6 is a top view of a folded shopping bag according to this invention.

The system according to the instant invention comprises a bag-making and folding machine 1 of the type described in my above-cited copending application No. 046,040 whose entire disclosure is herewith incorporated by reference. This machine 1 makes bags 2 that each have a top formed with a cutout 7 having an edge 8 and defining a pair of handle-loops 6. The lower end of the bag 2 is sealed by a continuous seam 10 and the upper ends of the handles 6 are sealed together at a pair of top-seam portions 11. The longitudinal edges of the bag are folded in to form inner creases that lie within the cutout 7 to give the handles 6 the desired loop form. The bags have an overall relatively great length and are folded by the machine 1 according to this invention generally in half along a fold line 5 spaced by a distance slightly larger than half of the overall bag length from the bottom seam 10. Thus a stack of such bags will present the upper bag as seen in FIG. 6 so that the user need merely slip his or her hand under the edge 8 to pick up the topmost bag only. An inexpensive synthetic resin such as polyethylene is normally used to manufacture these bags.

Figure 1:
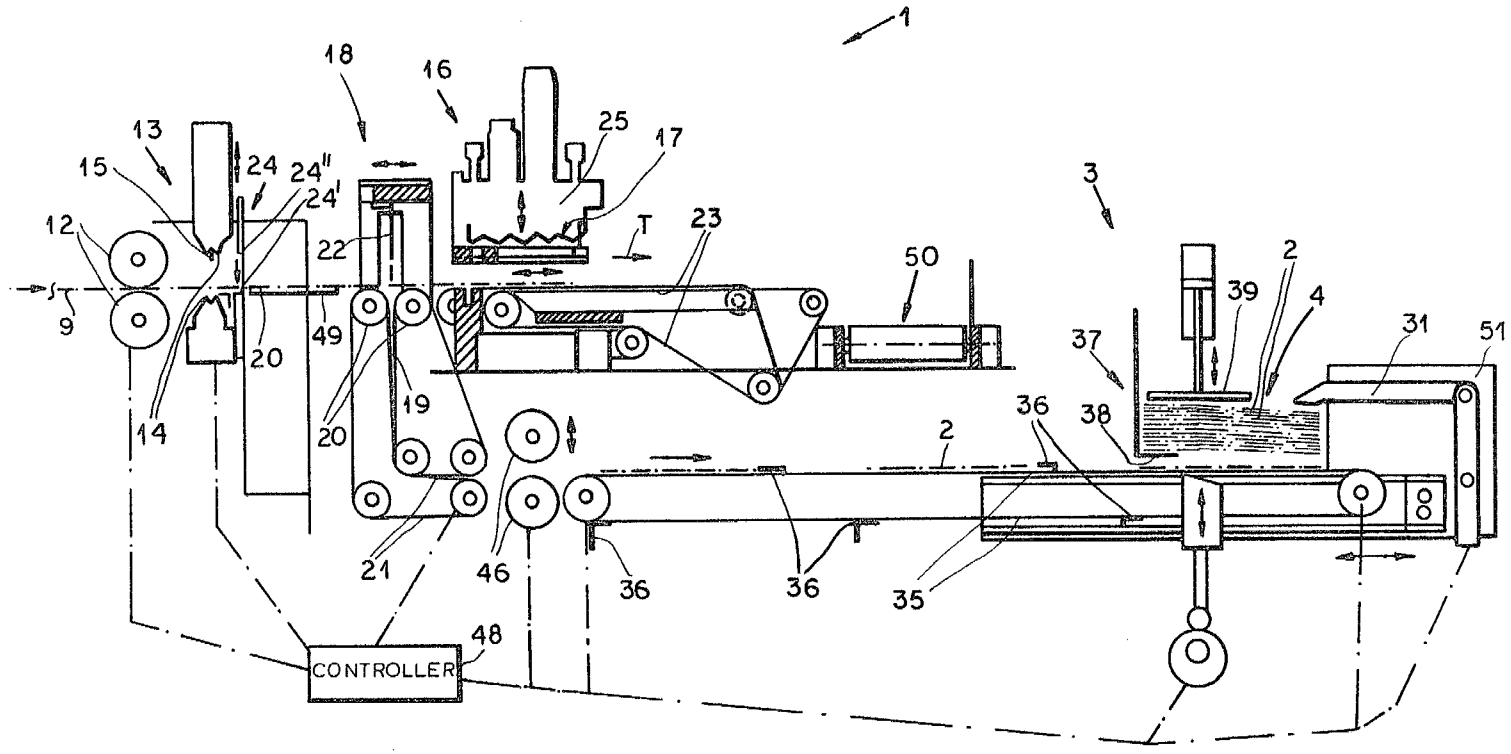
FIG. 1 is a side view partly in vertical section and partly schematic illustrating most of the apparatus according to this invention.

As shown in FIG. 1 the bags 2 are produced from a tubular workpiece 9 having the same section as the bags. An upstream conveyor formed by a pair of rollers 12 grips the tube 9 in flattened condition and is operated by a controller 48. These rollers 12 periodically rotate oppositely to pull a section having a length equal to the overall bag length off the roll of the tube 9.

Immediately downstream of the rollers 12 is a cutter-welder 13 having as shown in FIG. 1 welding tools 14 the upper one of which is subdivided into an upstream and a downstream part by a blade 15 that can fit into a gap in the anvil constituting the lower welding tool 14 for simultaneously forming a pair of welds in tube 9 and for severing the tube 9 completely across between these two welds which eventually form the top and bottom seams 10 and 11.

Spaced downstream of the cutter-welder 13 by a distance equal to the overall bag length is a puncher 16 having a die 17 vertically reciprocal by mechanism 25.

Upstream from the puncher 16 and downstream from the cutter-welder 13 is a folder 18 having a blade 22 vertically reciprocal into a fold gap or nip 19 formed between a pair of rollers 20 over which are spanned respective sets of conveyor belts 21.

Immediately downstream of the cutter 13 is a vertically reciprocal gripping device 24 comprising a lower gripping anvil 24' that serves and an upper vertically reciprocal gripper element 24'' to compress the tube 9 down against the anvil 24' to hold it tightly in place. Extending downstream from this anvil 24' is a smooth table 49. The downstream portion of the tube 9 is displaced over this table 49 by upper and lower blowing conveyor nozzles (not illustrated) directed downstream from the upstream conveyor rollers 12.

Downstream of table 49 and starting at the gap 19 is a downstream conveyor 23 extending downstream past the puncher 16 and comprised by a pair of perforated belts spanned underneath the puncher 16 over a pair of vacuum boxes connected to a blower so that the bag 2 will lie with its outer edges and handles 6 on these belts 23 and will be sucked down into engagement with them. These belts 23 are continuously driven in the transport direction T at a speed substantially greater than the maximum peripheral speed of the rollers 12 so as to hold the bag downstream of the cutter-welder 13 or gripper 24. At the downstream end of the belts 23 a transverse conveyor 50 is provided for carrying off the scrap cut from the tube 9 to form the cutouts 7.

The above-described apparatus operates as follows:

Assuming that the device is completely empty and is yet to make a single bag, the leading end of the tube 9 will be fed between the rollers 12 until it projects past the cutter-welder 13 which forms a top seam 11 fully across the tube 9. Thereafter the upstream conveyor rollers 12 will rotate while the above-described not-illustrated blowers are effective to displace the tube 9 by a distance equal to the overall bag length downstream. The suction belts 23 meanwhile hold this portion of the tube 9 taut.

Then the cutter-welder 13, upper gripper element 24'', and die 17 are all displaced downwardly. This simultaneously forms another pair of welds 10 and 11 across the tube 9 while severing the tube 9 across between these welds 10 and 11, grips the upstream end of the downstream portion that is thus cut off, and cuts off a section of the upstream end to form the handles 6.

The cutter-welder 13 is then opened and the punch 17 is lifted, with the punched-out section being carried away by a belt between the belts 23 and then by the transverse conveyor 50. At the same time the blade 22 of the folder is displaced downwardly by the controller 48 to fold the severed-off bag 2 along its middle and to engage it at its middle in the nip 19 between the belts 21.

Thereafter the blade 22 is lifted and the gripper 24 is opened to release the upstream end of the bag 2. The folded bag 2 is displaced downwardly between the belts 20.

For further details of the structure and operation of the bag-making machine 1 reference should be made to the above-cited copending application.

According to the instant invention the downstream ends of feed belts 21 open between a pair of feed rollers 46 of which the upper one is vertically displaceable and therethrough to a horizontally extending conveyor belt or chain 35 provided along its surface with equispaced clips 36. The rollers 46 are driven at a peripheral speed slightly greater than the advance speed of the belt 35, and the clips 36 are so arranged that each clip 36 will catch the leading edge of a respective bag 2 so as to advance it to a stacker 3 downstream in the direction T from the bag-making machine 1. This stacker 3 has a rear abutment 27 which is connected to the controller 48 so that it can simultaneously engage the clips 36 to open them and can signal to the controller 48 that a bag 2 lies immediately upstream of this stop 27 and downstream of a stacker plate 37 having a lower flange 38 that projects downstream but is situated slightly above the upper reach of the belt 35. When a bag 2 is thus positioned between the stop 27 and plate 37 a vertically reciprocal lifter engages upwardly between the two parallel belts 35 to press the upstream portion of the bag 2 against a stack 4 that is normally held down against the flange 38 by a pneumatic pusher 39. In this manner each time a foled bag 2 comes into a position aligned directly underneath the stack 4 of flat bags it will be pushed up and engaged underneath the stack 4 to form the lowermost bag in that stack 4. Within the stack 4 the bags 2 all are substantially planar, with their edges or outlines vertically aligned.

Figure 3:
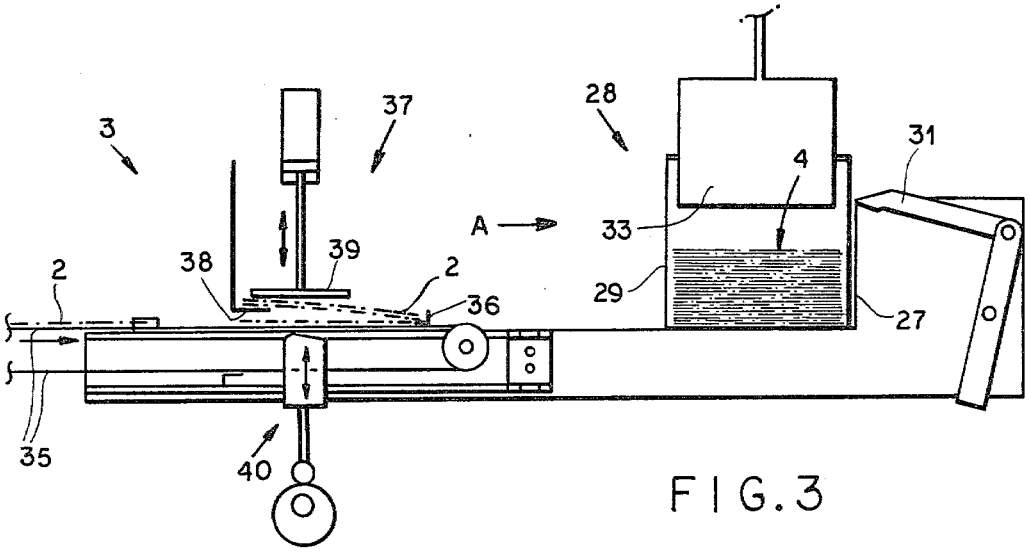
FIG. 3 is another side partly sectional and partly schematic view illustrating further portions of the apparatus according to this invention.

A pivotal gripper arm 31 engages through the stop 27 and is mounted with the stop 27 on a carriage 51 displaceable horizontally from the upstream position shown in FIG. 1 to a downstream position at a packaging station 28 shown in FIG. 3.

More particularly FIG. 3 shows how an open-ended cassette 29 is provided at this packaging station 28, having a floor formed with a throughgoing slot 32. This entire cassette 29 is of square shape with its ends open and is vertically displaceable and rotatable about an upright axis 41. Furthermore this cassette 29 is provided with a vertically displaceable and longitudinally elongated pusher or plunger 33 that can move down through the slot 32 in the floor of the cassette 29. Thus the entire cassette is actually formed as a downwardly open channel having a pair of flanges directed toward each other and forming the slot 32.

Figure 2:
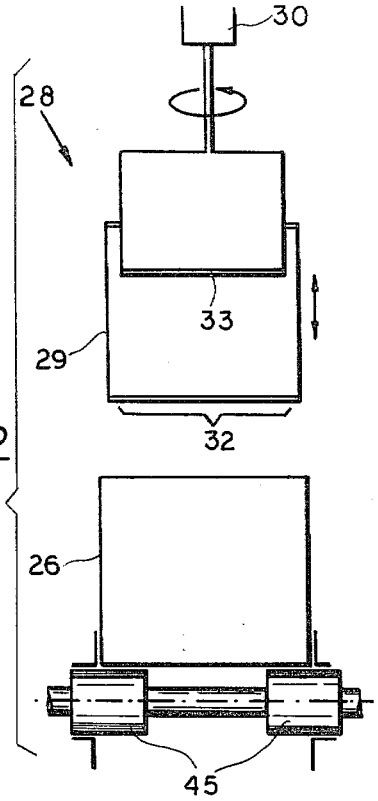
FIG. 2 is an end view of a detail of the apparatus.

FIG. 2 shows how a drive mechanism 30 can raise the entire cassette 29 so that a pair of belts 45 can transport an upwardly open cardboard shipping carton 26 into a position directly underneath this cassette 29, once the carriage 51 with the gripper 31 has been moved back into the upstream position of FIG. 1. The carriage 51 also forms the downstream stop 27.

Figure 4A:
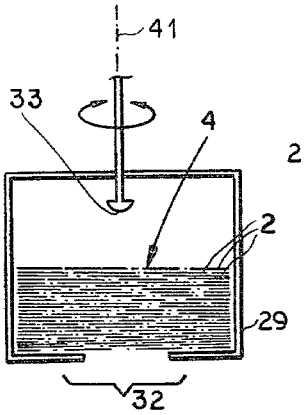
FIGS. 4A–4C are side sectional view illustrating the operation of a detail of the apparatus according to this invention.

With the system according to the instant invention, therefore, once a stack 4 of flat sheets is formed at the stacker 3 it can be engaged by the gripper 31 and pulled bodily out from engagement between the hold-down device 39 and the flange 38 and can indeed be pulled back into the cassette 29 until it is positioned therein as shown in FIGS. 3 and 4A. During this operation the plunger 33 is raised fully.

Thereafter as shown in FIG. 2 the entire cassette 29 is raised up and the carriage 51 is moved back so that the stacking operation can continue. In fact during this entire operation the belt 35 can continue to move so that the bagmaking machine 1 need not be shut down.

Once the cassette 29 holding the stack 4 of flat folded bags 2 is in the upper position shown in FIG. 2 the rollers or belts 45 displace an upwardly open cardboard carton 26 into a position directly aligned under the cassette 29.

Figure 4B:
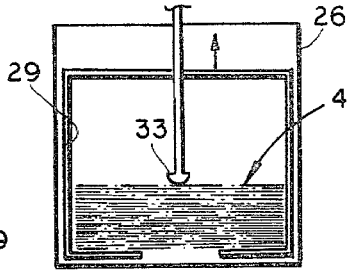

Thereafter as shown in FIG. 4B the entire cassette 29 is moved back down by the mechanism 30 into the carton 26 until the bottom of the cassette 29 rests on top of the floor of the carton 26. The plunger 33 is then displaced downwardly until it presses against the top of the stack 4 of flat bags 2 directly above the elongated slot, with the elongated pusher 33 parallel to and centered above this slot 32.

Figure 4C:
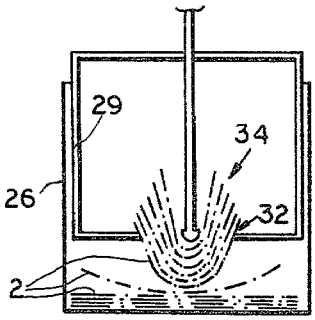

Thereupon as shown in FIG. 4C the cassette 29 is lifted up while the pusher 33 is held in its lower position so that the flat stack 4 is temporarily converted into a U-shaped stack 34 that is pushed through the slot 32. Once each bag 2 passes through the slot 32, however, it flattens out again to form another flat stack 4 inside the box 26.

Normally the system loads each carton 26 in several steps, so that the carton 26 carries a quantity of bags 2 equal to several stacks 4. Between each successive operation the cassette 29 is normally displaced through 90° or 180° about the axis 41 to ensure that the stacks 4 lie flatly in the carton 26.

Figure 5:
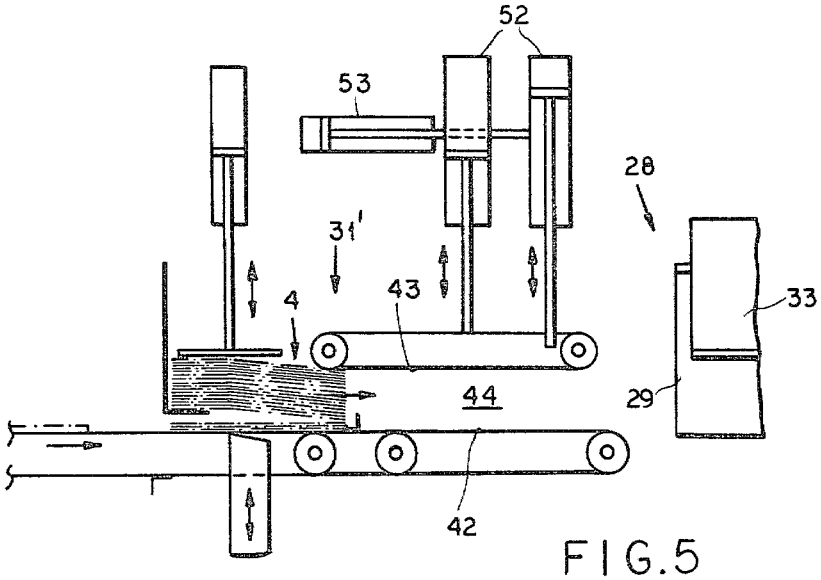
FIG. 5 is a side view corresponding to FIG. 3 illustrating an alternative arrangement according to this invention.

FIG. 5 shows how a gripper arrangement 31' can be constituted by a lower belt 42 and an upper belt 43 defining a gap 44. The upper belt 43 is biased downwardly by pneumatic cylinders 52 and can be displaced horizontally by a pneumatic cylinder 53. In this arrangement once the stack 4 has attained the desired height the belt 43 is driven and/or the cylinder 53 is operated to displace the entire stack 4 backwardly toward the packaging station 28. Thereupon the stack 4 is transferred to the cassette 29 in the manner described above.

Of course the system according to the instant invention can be adjusted to package bags of virtually any conventional length, merely by adjusting the relative positions of the various stations. What is more it is possible to provide several such systems according to the instant invention directly parallel to each other to form several boxes filled with bags at the same time.

I claim:

1. In combination with an apparatus which delivers to a stacking station a succession of like flat and flexible objects such as folded shopping bags, a packaging apparatus comprising:

means at said stacking station for stacking said objects up into a stack with said objects generally planar in said stack;

a laterally closed loading cassette in a packaging station adjacent said stacking station and having a floor formed with an elongated throughgoing slot, said floor being dimensioned to receive said stack with said objects generally planar;

transfer means including a gripper displaceable between said stations for gripping said stack in said stacking station, for displacing said stack with said objects in said stack generally planar into said cassette, and for depositing said stack with said objects in said stack generally planar on said floor over said slot;

means for positioning an upwardly open carton under and around said cassette; and means for relatively vertically displacing said cassette and carton while simultaneously pushing said stack in said cassette through said slot with temporary deformation of said objects into U-section as same pass through said slot to leave said stack with said objects generally planar in said carton.

2. The packaging apparatus defined in claim 1 wherein the stacking means comprises:

transport means having an endless transport element for regularly delivering said objects to said station in a transport direction;

a stack holder at said station having a flange spaced above said transport element and directed downstream;

a vertically displaceable lifter engageable from underneath with an object on said element in said station and engageable upwardly into said stack holder;

means for raising said lifter when one of said objects is aligned above it and underneath said flange for displacing the trailing edge of said one object from a position below said flange to a position above said flange; and means including a holddown for pressing the upstream edges of objects in said station down against said flange.

3. The packaging apparatus defined in claim 2 wherein said stacking means further comprises a plurality of clips on said transport element each capable of holding the leading edge of a respective object.

4. The packaging apparatus defined in claim 1 wherein said cassette is vertically displaceable and said means for pushing includes a pusher in said cassette vertically displaceable downwardly through said slot while engaging the stack in said cassette to force same through said slot.

5. The packaging apparatus defined in claim 1 wherein said cassette is rotatable about an upright axis, said packaging apparatus further comprising means for rotating said cassette after same is loaded with a stack.

6. The packaging apparatus defined in claim 1 wherein said gripper is engageable from above and below with the stack in said stacking station and is displaceable horizontally between said stations and through said cassette.

7. The packaging apparatus defined in claim 1 wherein said gripper is a pair of vertically spaced and generally parallel belts extending horizontally between said stations.

8. The packaging apparatus defined in claim 1 wherein the positioning means includes a conveyor extending away from said packaging station.

9. A method of packaging like flat and flexible objects such as folded shopping bags that are delivered one at a time to a stacking station, said method comprising the steps of:

stacking said objects as they arrive at said stacking station into a stack with said objects generally planar in said stack;

gripping said stack and transferring it with said objects generally planar to a laterally closed loading cassette having a floor dimensioned to receive said stack with said objects generally planar, said floor being formed with an elongated slot;

positioning an upwardly open carton under said cassette containing said stack; and thereafter pushing said stack downwardly through said slot into said carton with temporary deformation of said objects from planar into U-shape as they pass through said slot and subsequent deformation of said objects back into planar shape when in said carton.

10. The method defined in claim 9 wherein said stack is pushed downwardly through said slot by engaging said stack above said slot with a pusher and then upwardly displacing said cassette while holding said pusher substantially against vertical displacement.

11. The method defined in claim 9 wherein said stack is gripped from above and below and is thus transported between said stations.

12. The method defined in claim 9 wherein said objects are stacked by being pressed upwardly against the bottom of the stack in said stacking station and holding said objects in place on said stack.

* * * * *